United States Patent [19]

Jucker et al.

[11] 4,012,941

[45] Mar. 22, 1977

[54] METHOD OF AND APPARATUS FOR MEASURING THE AMPLITUDE OF OSCILLATION OF THE BALANCE OF A TIMEPIECE MOVEMENT

[75] Inventors: Erich Jucker; Yvan Greiner, both of La Chaux-de-Fonds; André Lehmann, Peseux, all of Switzerland

[73] Assignee: Portescap, La Chaux-de-Fonds, Switzerland

[22] Filed: Jan. 13, 1976

[21] Appl. No.: 648,817

[30] Foreign Application Priority Data

Jan. 14, 1975 Switzerland ..... 407/75

[52] U.S. Cl. ..... 73/6

[51] Int. Cl.[2] ..... G04D 7/12

[58] Field of Search ..... 73/6

[56] References Cited

UNITED STATES PATENTS

| | | | |
|---|---|---|---|
| 2,782,627 | 2/1957 | Hetzel | 73/6 |
| 3,002,371 | 10/1961 | Borer | 73/6 |

*Primary Examiner*—S. Clement Swisher
*Attorney, Agent, or Firm*—Arthur V. Smith

[57] ABSTRACT

A method of and apparatus for measuring the amplitude of oscillation of the balance of a timepiece movement having an escapement adapted for disengagement and engagement, successively, the balance having a predetermined angle of lift. The time intervals between successive disengagement and engagement are measured, as are the durations of vibration of the balance. The number of pulses of a first frequency which are produced during at least one of the measured time intervals is counted. The number of pulses of a second frequency produced during at least one of the vibration durations also is counted. The first and second frequencies have a predetermined relationship with respect to each other. The number of counted pulses of the second frequency is divided by the number of counted pulses of the first frequency to thereby attain a quotient which is equal to the amplitude of oscillation.

18 Claims, 4 Drawing Figures

METHOD OF AND APPARATUS FOR MEASURING THE AMPLITUDE OF OSCILLATION OF THE BALANCE OF A TIMEPIECE MOVEMENT

BACKGROUND OF THE INVENTION

This invention relates to the measuring of the amplitude of oscillation of a balance of a timepiece movement and, more particularly, to a method of and apparatus for linearly measuring this amplitude by using digital techniques.

In evaluating the operation of timepiece movements, such as watch movements, or the like, it is desirable to measure the amplitude of oscillation of the balance. When timepiece movements of a relatively small size are to be evaluated, it often is difficult to attain accurate measurements of such an amplitude of oscillation. Many of the techniques which presently are used for this measurement are complex and expensive. For example, one such technique relies upon the use of a graduated cathode ray tube. In use, the electron beam scans the graduations during cathode ray tube. In use, the electron beam scans the graduations during each swing, or alternation, of the watch movement. A skilled technician must be capable of tracking this moving beam and evaluating the cathode ray tube display.

In accordance with another technique, a conventional moving-coil type of instrument is used. The information displayed by this instrument also requires particular skills of a technician in order to evaluate the performance of the measured watch movement.

In addition to the foregoing techniques, analog electrical measuring apparatus have been used to measure the relationship between various watch movement parameters to thereby derive an indication of the amplitude of oscillation of the balance. In general, the swing of the balance between disengagement and engagement in both the forward and return directions of the balance occurs in a period of time $\Delta T$ which can be measured. Also, for a given watch movement, the angle of lift $\tau$ and the rate of the balance wheel likewise can be obtained. These parameters are related in accordance with the following mathematical representation:

$$\frac{\tau}{2} = A \sin\left(w \cdot \frac{\Delta T}{2}\right) \qquad (1)$$

This equation can be electronically simulated by the use of relatively simple analog circuits. However, in order to avoid a complex and, consequently, costly system, the analog implementation of this equation results in a non-linear measurement of the amplitude of oscillation A. This, in turn, results in a lack of precision in the measurement.

OBJECTS OF THE INVENTION

Therefore, it is an object of the present invention to provide an improved method of and apparatus for measuring the amplitude of oscillation of the balance of a timepiece movement which avoids the problems noted hereinabove.

Another object of this invention is to provide a method of and apparatus for measuring the amplitude of oscillation of a balance whereby the measured amplitude is a near-perfect linear measurement.

Another object of this invention is to provide a method of and apparatus for measuring the amplitude of oscillation of a balance wherein digital techniques are used whereby the resultant measurement is highly precise.

A still further object of this invention is to provide a method of and apparatus for measuring the amplitude of oscillation of a balance wherein relatively simple digital electronic circuits are used with a concurrent economic saving.

An additional object of this invention is to provide a method of and apparatus for measuring the amplitude of oscillation of a balance wherein the measured amplitude selectively is determined during one or the other of the swings of the balance during a vibration period, or the measured amplitude is averaged over the entire vibration period.

Various other objects and advantages of the present invention will become readily apparent from the ensuing detailed description, and the novel features will be particularly pointed out in the appended claims.

SUMMARY OF THE INVENTION

In accordance with the present invention, a method of and apparatus for measuring the amplitude of oscillation of the balance of a timepiece movement having an escapement adapted for disengagement and engagement, successively, the balance having a predetermined angle of lift, are provided wherein the time intervals between successive disengagement and engagement of the balance are measured; the duration of vibration of the balance is measured; a series of pulses having a first frequency is counted during at least one of the measured time intervals; a series of pulses having a second frequency is counted during at least one of the vibration durations; the first and second frequencies exhibiting a predetermined relationship relative to each other; and the number of pulses of the second frequency which have been counted is divided by the number of pulses of the first frequency which have been counted, resulting in a quotient which is equal to the amplitude of oscillation.

BRIEF DESCRIPTION OF THE DRAWINGS

The following detailed description, given by way of example, will best be understood in conjunction with the accompanying drawings in which.

DETAILED DESCRIPTION OF A CERTAIN ONE OF THE PREFERRED EMBODIMENTS

Figure 1:
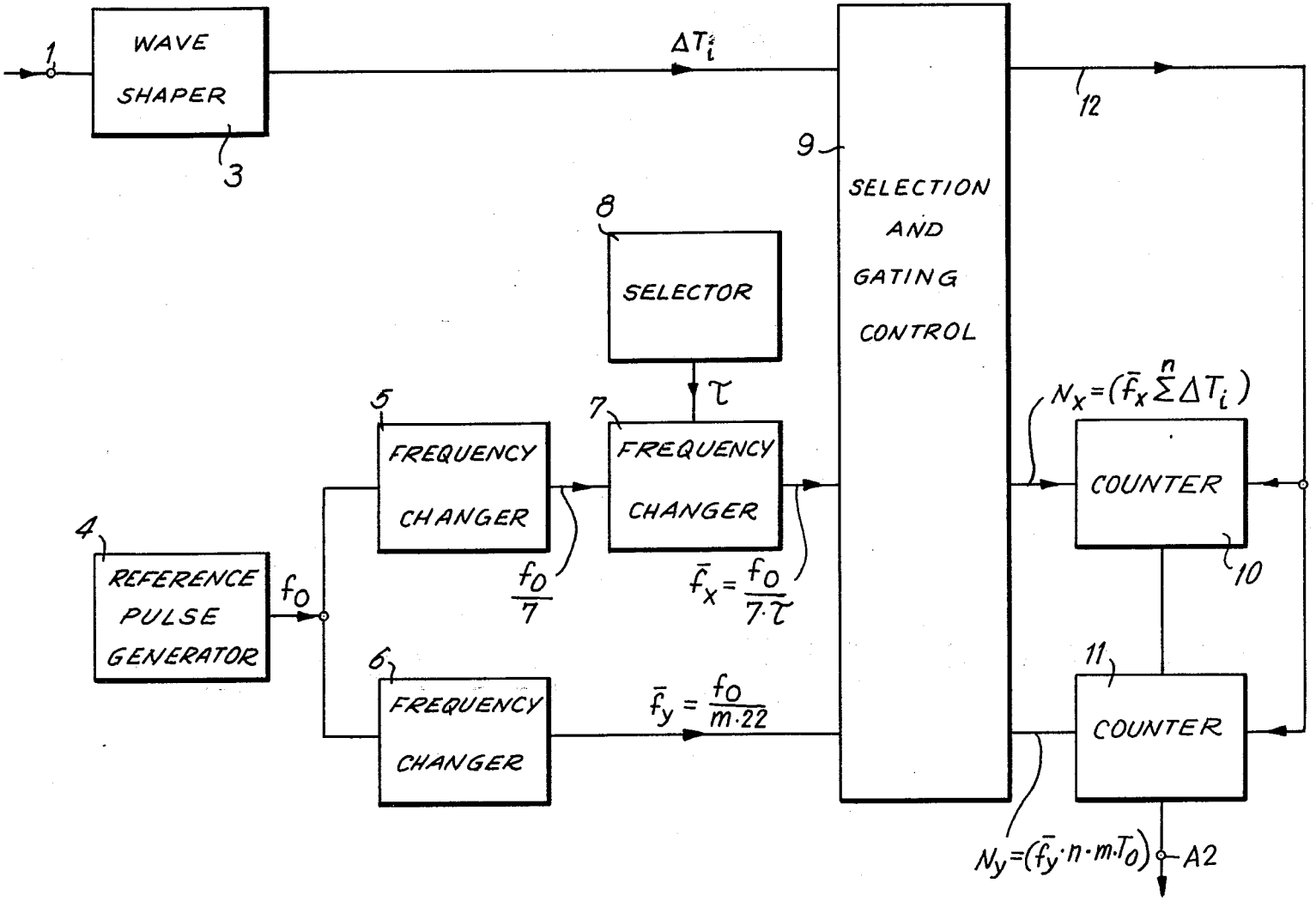
FIG. 1 is a block diagram of the apparatus capable of carrying out the method of the present invention.

Referring now to the drawings, and in particular to FIG. 1, there is illustrated a block diagram of the apparatus which is capable of carrying out the method of the present invention. The method, and illustrated apparatus, proceed upon the principle of carrying out the mathematical relation defined by equation (1) hereinabove. In particular, measurements are made during the linear portion of the sinusoid corresponding to the swing of the balance. Consequently, the sine function of the angle within the parenthesis of equation (1) is substantially equal to the angle itself, measured in radians. Furthermore, since the rate $\omega$ of the balance is equal to $2\pi f$, where $f$ is the oscillation frequency, then the duration of vibration $T_o$, which is equal to half the duration of an oscillation, is equal to $1/2f$. Consequently, equation (1) can be rewritten as follows:

$$A = \frac{\tau}{\pi} \cdot \frac{T_o}{\Delta T} \quad (2)$$

The apparatus illustrated in FIG. 1 carries out the mathematical relation of equation (2).

Indications of the time interval between disengagement and engagement of the balance are supplied as electrical signals to an input terminal 1. Although forming no part of the present invention per se, such indications can be provided by a microphone which is adapted to detect the unique sounds associated with the movement of the balance. A typical microphone is of the type described in U.S. Pat. No. 3,026,707 to F. Marti et al. As is known, when the balance swings in one direction and then in a reverse direction during each cycle of oscillation thereof, disengagement and engagement sounds occur at the beginning and end of a prescribed sector of the angular swing. Thus, by detecting these sounds, the corresponding time interval is defined. The angle of lift $\tau$ generally is known for the particular timepiece movement which is under measurement. The sounds of disengagement and engagement, together with this angle of lift, are used by the illustrated apparatus to precisely measure the amplitude of oscillation of the balance.

The aforenoted sounds, which may appear as pulse-like signals applied to the input terminal 1, are detected and shaped by a wave shaping circuit 3, thereby producing a series of timing pulses having a pulse duration equal to $\Delta T$, the time interval between a disengagement and an engagement. This time interval $\Delta T$ occurs during one alternation of the cycle of oscillation of the balance, and two alternations comprise an oscillation period.

As will be described in greater detail hereinbelow, the timing pulses produced by the shaping circuit 3 are supplied to a selection and gating circuit 9. Also supplied to this selection and gating circuit are first and second pulse trains having different but related frequencies. The apparatus for producing these pulse trains now will be described.

A reference generator 4 having a highly stable frequency is provided to generate reference pulses having a frequency $f_o$. Preferably, the reference generator is comprised of a crystal oscillator, such as a quartz oscillator, or the like.

The reference pulses are adapted to be supplied to two frequency changing circuits in order to produce the respective pulse trains. It may be appreciated that, in accordance with equation (2) hereinabove, the frequency of the first pulse train should be related to the frequency of the second pulse train in accordance with the ratio $\tau/\pi$. This can be achieved by dividing the reference pulse frequency $f_o$ by the factor $\pi$ and by further dividing the reference frequency $f_o$ by the factor $\tau$. Although this technique would yield the desired frequency ratio, it is quite difficult and expensive to provide apparatus capable of dividing a frequency by the factor $\pi$. Consequently, the illustrated apparatus performs an equivalent function to achieve the same frequency ratio, but employs relatively simple, conventional apparatus. More particularly, the first frequency changing circuit is comprised of a first divider circuit 5 capable of dividing the reference frequency $f_o$ by the constant factor 7 and a series-connected divider circuit 7 which is capable of dividing the frequency of the pulse signal applied thereto by the factor $\tau$. As a result of the two stages of division provided by the frequency dividers 5 and 7, the resultant signal derived from the divider circuit 7 has a frequency $f_x$ which is equal to $f_o/7\tau$. This signal is supplied to the selection and gating circuit 9.

It is recalled that the angle of lift $\tau$ can differ from one timepiece under measurement to another. Accordingly, it is preferred that the frequency divider 7 be of the type having an adjustable dividing ratio. One example of such a circuit is a counter circuit having presettable stages. A more detailed description of this divider circuit 7 is provided hereinbelow with respect to the logic diagram of FIG. 2*a*. Suffice it to say that a selector circuit 8 is connected to the divider circuit 7 for the purpose of selectively establishing the divider ratio of the divider circuit. The selector circuit 8 may comprise a conventional manually operable selecting device.

The frequency changing circuit 6 is a frequency divider adapted to divide the reference frequency $f_o$ of the reference pulses by a constant factor. This constant factor is equal to $22m$, where $m$ is an integer, for a purpose soon to be described. The signal obtained from the frequency dividing circuit 6 is supplied to the selection and gating circuit 9. If $m$ is equal to unity, it is appreciated that the frequency of the signals produced by the circuit 6, $f_y$ which is equal to $f_o/22m$, and the frequency of the signal obtained from the circuit 7, $f_x$ which is equal to $f_o/7\tau$, exhibit the ratio $\tau/\pi$. This ratio permits equation (2) to be followed.

The selection and gating circuit 9, described in greater detail hereinbelow, is adapted to transmit the pulses produced by the divider circuit 7 to a counter circuit 10 during selected time intervals $\Delta T$. The number n of these time intervals during which the pulses are transmitted is selectable by an operator, as will be described. The selection and gating circuit 9 further serves to transmit the pulses produced by the divider circuit 6 to a counter 11 during durations of vibration of the balance. As will soon become apparent, the factor $m$ which determines the frequency $f_y$ of these pulses is selectable by the selection and gating circuit so as to provide a number of pulses which would be transmitted equivalently during m durations of vibration. The number of pulses $N_x$ of frequency $f_x$ which are transmitted during the n time intervals $\Delta T$ are counted by the counter circuit 10. The counter circuit 11 functions as a pulse group counting circuit and is adapted to have selected stages thereof preset in accordance with the count attained by the counter circuit 10. With these preset stages, the counter circuit 11 is adapted to count the number of pulses $N_y$ having the frequency $f_y$ which are transmitted during the durations of vibration. By reason of these preset stages, the counter circuit 11 functions as a divider whereby the number of pulses $N_y$ is divided by the counted pulses $N_x$. The resultant quotient A is supplied to an output terminal 2. This quotient A is represented by a number of pulses, this number being equal to the amplitude of oscillation of the balance.

As also shown, the selection and gating circuit 9 is connected in common to the counter circuits 10 and 11 by a conductor 12. This conductor 12 is adapted to be supplied with a reset signal at the conclusion of each measurement interval so that the respective counter circuits can be reset to their initial states. As will soon be explained, the measurement interval is equal to $n.m.T_o$.

Figure 2A:
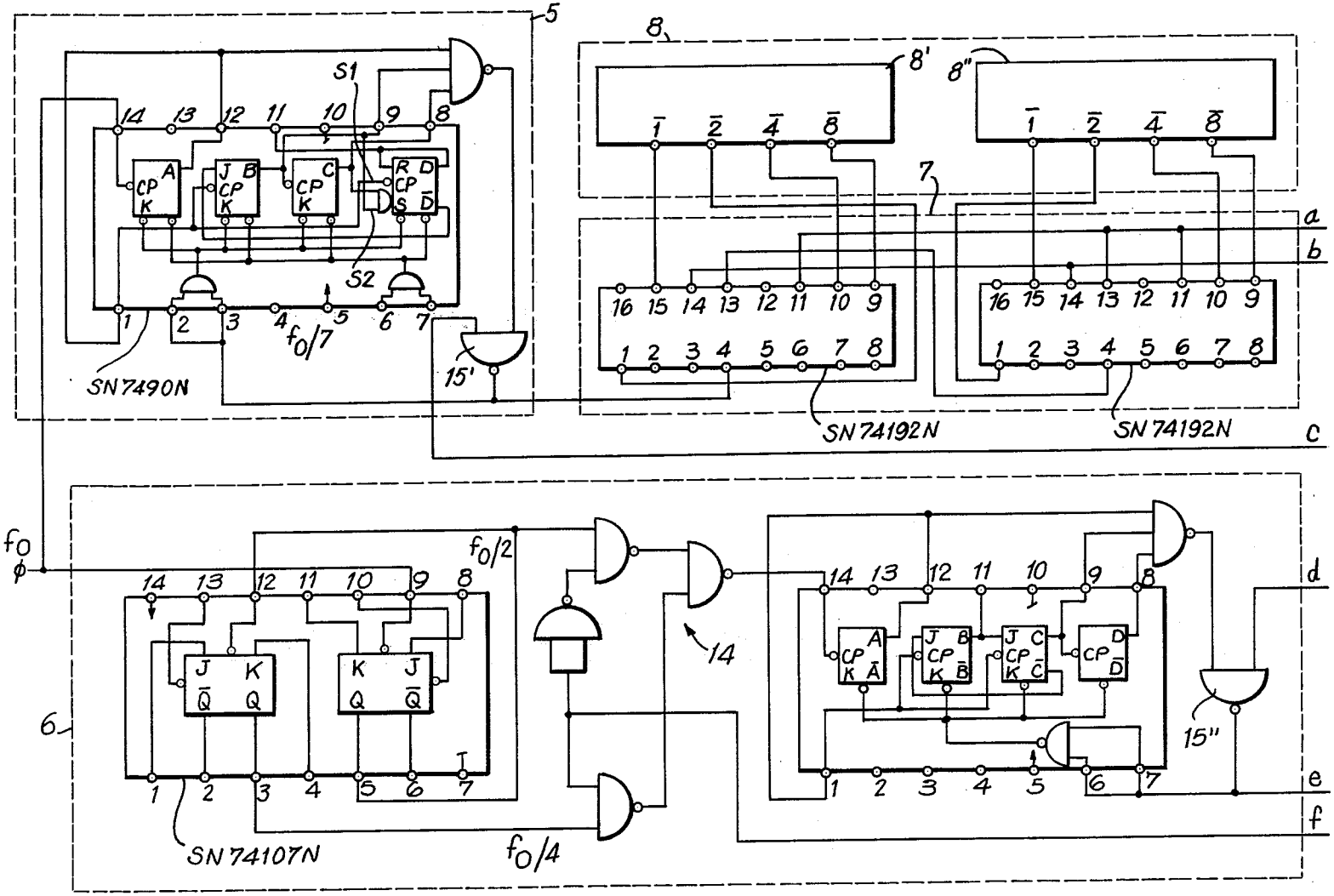
FIGS. 2A–2C are logic diagrams corresponding to various ones of the blocks depicted in FIG. 1.
Figure 2B:
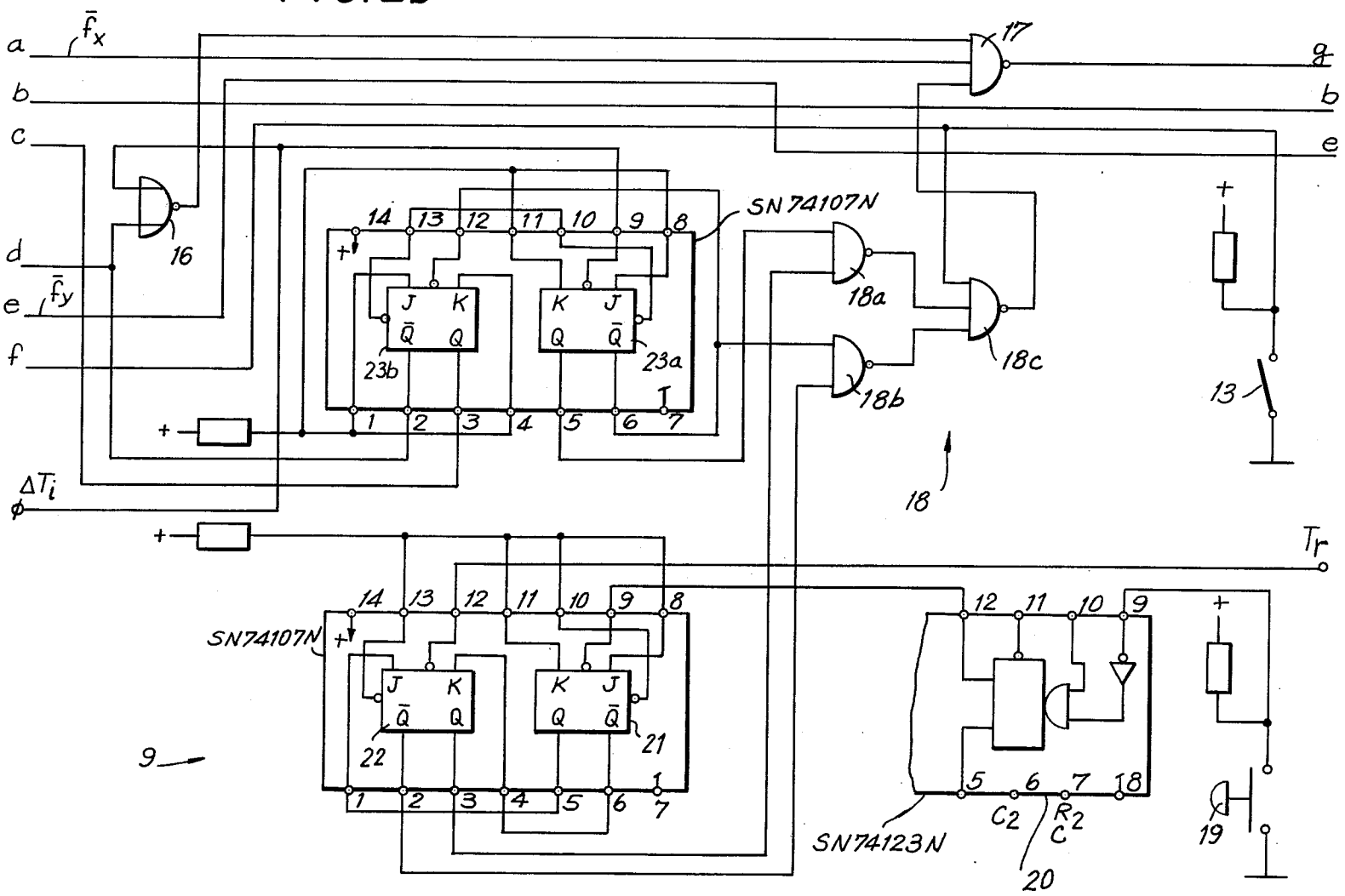
Figure 2C:
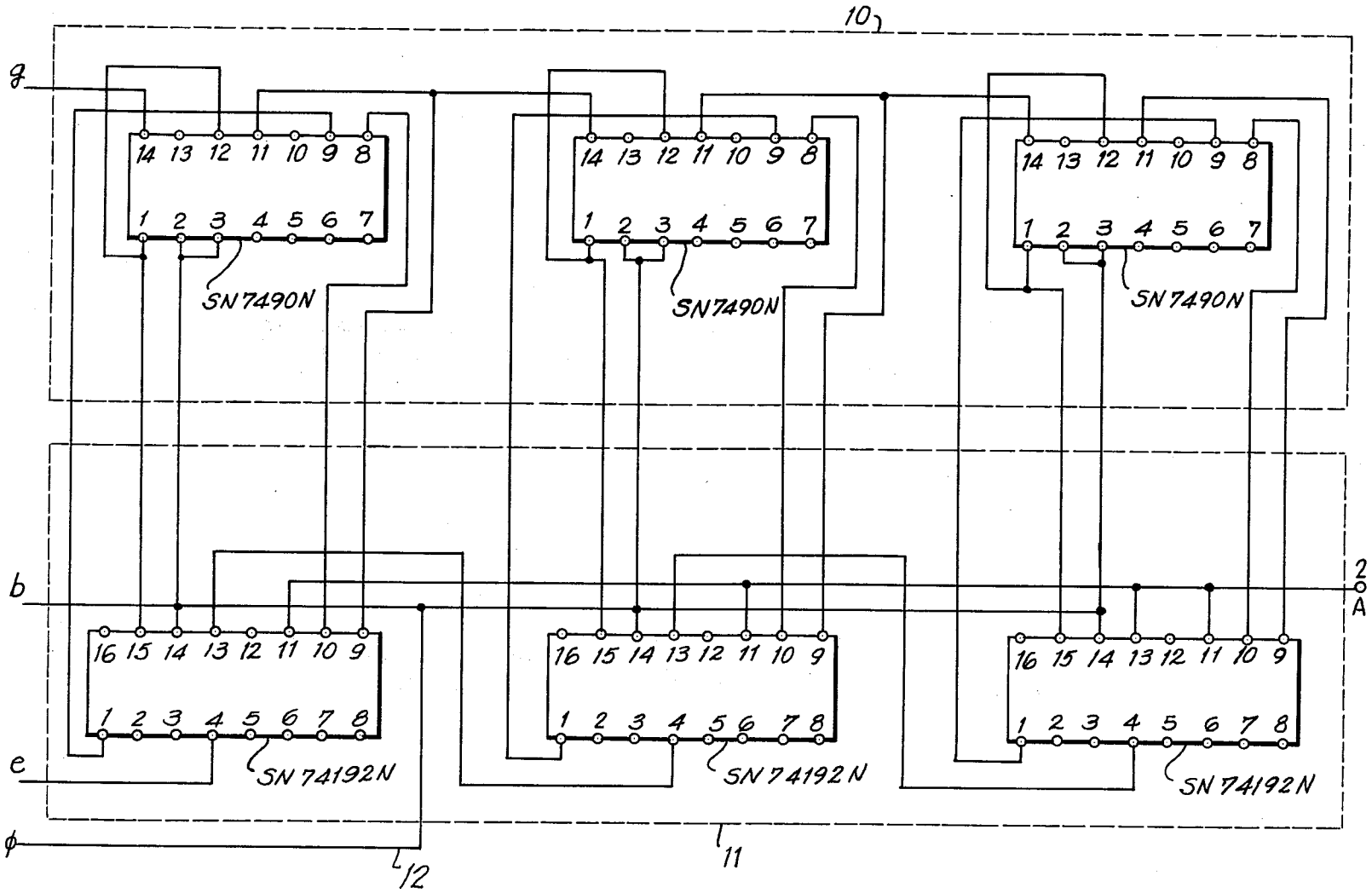

Referring now to FIGS. 2*a*, 2*b* and 2*c*, a logic diagram corresponding to the block diagram previously described in respect of FIG. 1 is illustrated. The various components of the logic diagram shown in FIGS. 2*a*–2*c* are interconnected by the illustrated conductors *a*–*g*, respectively. The individual logic circuits are conventional and, for the purpose of the present discussion, are of the TTL type such that manufactured by Texas Instruments Company. Such logic circuits are, of course, commercially available and, although not intended to limit the present invention thereto, these logic circuits are identified by their manufacturers' model numbers.

In FIG. 2*a*, the frequency changing circuit 5 is shown as a divide-by-seven frequency divider which is adapted to receive the reference pulses having the reference frequency $f_o$ and to divide this frequency by the factor of 7. The pulses having this divided frequency are produced at the output of the NAND gate which is seen to be connected to the output terminals identified as pins 8, 9 and 12 of the illustrated SN 7490N circuit. These pulses then are supplied through a gate circuit 15' to the divider circuit 7. The purpose of the gate circuit 15' is to synchronize the divided frequency pulses with various clock signals produced by the selection and gating circuit 9, shown in greater detail in FIG. 2*b*. The clock synchronizing pulse which is produced by the selection and gating circuit 9 is supplied to the NAND gate 15' by the conductor *c*.

The synchronized, frequency-divided pulses derived from the NAND gate 15' are supplied to the divider circuit 7, as shown. In the illustrated circuit, the divider circuit is comprised of two SN 74192N circuits which function as presettable frequency dividers. Selected stages of these divider circuits are connected to the selector circuit 8, which is seen to be comprised of first and second selector circuits 8' and 8''. Each selector circuit is adapted to supply a binary signal capable of presetting the respective SN 74192N circuits to their presettable counts. In this manner, the frequency of the pulses supplied by the NAND gate 15' is divided in accordance with the ratio established by the binary signals provided by the selector circuits 8' and 8''. The resultant pulse signal has a frequency $f_x$ which is equal to $f_o/7\tau$, and is supplied to the conductor *a*. The divider circuit 7 is adapted to be reset to an initial count, such as the preset count established by the selector circuits 8' and 8'', in response to a reset pulse applied thereto via the conductor b. This reset pulse will be described further hereinbelow.

As also shown in FIG. 2*a*, the frequency changer circuit 6 is comprised of a first divider circuit formed of an SN 74107N and a second divider circuit formed of an SN 7492N. The first divider circuit is comprised of first and second clocked flip-flop circuits, such as J-K flip-flop circuits, the output of the first J-K flip-flop circuit being connected to the second such flip-flop circuit. In this fashion, the first flip-flop circuit is capable of dividing the reference frequency $f_o$ by the factor of 2, and the second J-K flip-flop circuit is capable of further dividing this frequency by an additional factor of 2. Thus, the output of the first flip-flop circuit is derived from pin 5 and exhibits a frequency $f_o/2$, while the output of the second flip-flop circuit is derived from pin 3 and has a frequency $f_o/4$.

A gating circuit 14 is adapted to receive the pulses having the frequencies $f_o/2$ and $f_o/4$, respectively, and to selectively supply one or the other of these pulse signals to the divider circuit formed of the SN 7492N. A control signal is adapted to be supplied to this gating circuit 14 by the conductor *f* for the purpose of selecting which of the frequency-divided pulse signals is to be supplied to the further divider. The stages of the further divider circuit are interconnected so as to divide the frequency of the pulses supplied thereto by a factor of 11. Thus, depending upon the selected actuation of the gating circuit 14, the frequency of the pulses produced at the output of this second divider circuit has a frequency equal to $f_o/22$ or $f_o/44$. It may be appreciated that, if desired, additional divider stages may be included and further gating networks may be provided so that the output of the SN 7492N has a frequency which can be described generally as $f_o/m.22$. This output signal is produced by the NAND gate connected to the output pins 8, 9 and 12, and is supplied to a NAND gate 15''. The purpose of this NAND gate 15'' is to synchronize the pulses having the frequency $f_o/m.22$ with the clock pulse signals produced by the selection and gating circuit 9. Accordingly, a selected clock pulse signal is supplied to the NAND gate 15'' by a conductor *d*. It will soon be seen that this clock pulse signal applied via the conductor d has a pulse duration equal to a duration of vibration of the balance. Consequently, the pulse signals having the frequency $f_o/m.22$, supplied by the NAND gate 15'', are transmitted through this NAND gate to a conductor e during selected vibration durations.

The frequency-divided signals produced by the divider circuit 7 and applied to the conductor a, having the frequency $f_x$ equal to $f_x/7\tau$, are further applied to a NAND gate 17. The purpose of this NAND gate is to transmit the pulses having the frequency $f_x$ to a conductor *g* selectively during two successive intervals between disengagement and engagement, or during the first interval of a vibration duration, or during the second interval of a vibration duration. The operation of the NAND gate 17 to transmit the pulses having the frequency $f_x$ in this manner is controlled by a manually operable selector switch 13, a NOR gate 16 and a gating circuit 18.

The manner in which the aforementioned circuits control the operation of the NAND gate 17 now will be described. It is recalled from FIG. 1 that the timing pulses produced by the shaping circuit 3 and having the pulse duration $\Delta T_i$ are supplied to the selection and gating circuit 9. This is illustrated at the input terminal at the left-most portion of the logic circuit of FIG. 2*b*. This timing pulse signal is supplied to the divider circuit 23 which is seen to be substantially similar to the aforedescribed SN 74107N included in the divider circuit 6 of FIG. 2*a*. In particular, this timing pulse signal is supplied to the divider stage **23*a* which is adapted to divide the frequency of the timing pulses by two. It is appreciated that the pulses thus derived at the output pins 5 and 6 of the stage 23*a* are of equal frequency and of opposite phase. These oppositely-phased frequency-divided timing pulses are supplied to the NAND gates 18*a* and 18*b* included in the gating circuit 18, as shown. Thus, the NAND gates 18*a* and 18*b*** are thereby conditioned to transmit signals which are supplied to their other respective inputs.

In addition, the pulses derived at the ouput pin 6 of the stage **23*a* are supplied to the stage 23*b*** to be divided by an additional factor of 2. As a result of this additional division, pulses are derived at the output pins 2 and 3 which are equal in frequency to each other but are of opposite phase. The duration of each of these pulses is equal to the oscillation period. Stated otherwise, the period of the pulses produced at the output pins 2 and 3 on the stage 23*b* is equal to four alternation intervals, or two oscillation periods. The frequency-divided timing pulses derived at the output pin 2 of the stage 23*b* are supplied to the conductor *d*, and, in addition, to another input of the NOR gate 16. The frequency-divided timing pulses derived at the output pin 3 of the stage 23*b* are supplied to the conductor *c*. Therefore, it should be appreciated that the NAND gate 15″ included in the divider circuit 6 shown in FIG. 2*a* is conditioned to transmit the pulses $f_y$ during two alternation intervals. Similarly, the NAND gate 15′ included in the divider circuit 5 of FIG. 2*a* is conditioned to permit the transmission of pulses having the frequency $f_x$ during the next two alternation intervals. Consequently, when a group of four successive alternation intervals is considered, the pulses having the frequency $f_x$ will be transmitted during two successive alternation periods in this group and the pulses having the frequency $f_y$ will be transmitted during the remaining two alternation periods.

In view of the timing pulses ΔT supplied to the NOR gate 16 together with the frequency-divided timing pulses supplied thereto from the output pin 2 of the stage 23b, it should be appreciated that the NOR gate 16 supplies two successive timing pulses ΔT to the NAND gate 17 for each group of four alternation intervals. For the purpose of the present discussion, it will be assumed that these two timing pulses are the first two such timing pulses in the group of four timing pulses. Now, depending upon the signal supplied to the NAND gate 17 by the gating circuit 18, the pulses having a frequency of $f_x$ will be transmitted by the NAND gate 17 either during both timing pulses, as supplied by the NOR gate 16, or during one or the other such timing pulse.

The manually actuable switch 13 is adapted to control the gating circuit 18 such that the gating circuit enables the NAND gate 17 to transmit the pulses of frequency $f_x$ either during both of the timing pulses transmitted by the NOR gate 16 or during only one of these timing pulses. A further manually operable selector switch 19 is provided to select which of the two timing pulses is to be used for the transmission of such pulses $f_x$. It may be appreciated that the number of pulses $f_x$ which are transmitted during a timing pulse is an indication of the duration thereof. Thus, pulses of the frequency $f_x$ which are transmitted during one such timing pulse are used to measure the amplitude of the balance forward swing or reverse swing, depending upon which timing pulse is used. Alternatively, if the pulses of frequency $f_x$ are transmitted by the NAND gate 17 during both timing pulses, then such transmitted pulses represent the summation of the amplitude of the forward swing of the balance and the reverse swing thereof. Thus, by operating the selector switches 13 and 19, an operator can measure the amplitude of oscillation during a forward swing or during a return swing or can average this amplitude over an entire oscillation period. This function will become apparent from the following description.

When the switch 13 is disposed in its first state, for example, when it is closed, a relatively low potential is supplied to the NAND gate 18*c* and, in addition, to the conductor *f*. This relatively low potential causes the output of the NAND gate 18*c* to condition the NAND gate 17 so as to respond to the combination of pulses supplied thereto by the conductor a and the NOR gate 16. State otherwise, the NAND gate 17 thus is conditioned to transmit the pulses $f_x$ during both timing pulses, as determined by the NOR gate. Conversely, when the switch 13 is disposed in its second state, for example, when it is opened, a relatively high potential is supplied to the NAND gate 18*c*, thus conditioning the NAND gate to transmit pulses which are selectively applied thereto by the NAND gates 18*a* and 18*b*.

Before describing the operation of the SN 74107N circuit, it should be noted that, depending upon the state of the switch 13, a corresponding control signal is applied via the conductor f to the gating circuit 14 included in the divider circuit 6 of FIG. 2*a*. That is, when the switch 13 is closed such that the NAND gate 17 is conditioned to transmit pulses of frequency $f_x$ during two successive timing pulses ΔT, the gating circuit 14 is likewise conditioned to transmit frequency-divided pulses of frequency $f_o/2$ to the divide-by-eleven circuit. Thus, the closing of the switch 13 causes the factor *m* to be equal to unity. Conversely, when the switch 13 is opened such that the NAND gate 17 is conditioned to transmit pulses of frequency $f_x$ during only one timing pulse ΔT, the gating circuit 14 concurrently is conditioned to transmit the frequency-divided pulses of frequency $f_o/4$ to the divide-by-eleven circuit. Thus, when the switch 13 is opened, the factor *m* is set equal to 2. Hence, depending upon the state of the switch 13, the number of pulses which are transmitted by the NAND gate 15″ during a vibration duration, as determined by the frequency-divided timing pulses applied to the conductor *b*, is twice as great when the switch 13 is closed as when this switch is opened. This is equivalent to transmitting the same number of pulses of frequency $f_y$ during each vibration duration, but when the switch 13 is closed, such pulses are transmitted during two vibration durations; whereas when the switch 13 is opened, the pulses of frequency $f_y$ are transmitted during only one vibration duration.

That portion of the illustrated logic circuit which is used to determine which of the timing pulses ΔT the pulses of frequency $f_x$ are transmitted by the NAND gate 17 now will be described. The manual selector switch 19 is connected to an input pin 9 of a pulse shaping circuit 20. As one example thereof, this pulse shaping circuit is included in and forms a part of an SN 74123N. As one example thereof, this pulse shaping circuit may comprise a one-shot, or monostable, circuit. Thus, depending upon the state of the switch 19, that is, whether this switch is opened or closed, the pulse shaping circuit 20 triggers to produce an output pulse at its output pin 12. For the purpose of the present discussion, it will be assumed that a pulse is produced at the output pin 12 of the pulse shaping circuit 20 when the switch 19 is closed. Of course, as is readily apparent, the alternative can obtain, whereby such an output pulse is produced when the switch 19 is opened.

The pulse shaping circuit 20 is connected to a first stage 21 of an SN 74107N. This first stage is seen to be a clocked flip-flop circuit, such as a J–K circuit, and is adapted to change its stable state in response to a pulse transition of predetermined direction supplied to its clock input pin 9. It is seen that the outputs of the stage 21 are connected to the inputs of the stage 22. In addition, a clock input pin 12 of the stage 22 is adapted to be supplied with a transfer pulse $T_r$ which is produced at the beginning (or end), of each group of four successive alternation intervals. Although not shown herein, one of ordinary skill in the art will appreciate that the respective outputs of the stage 23, together with NOR gate 16, can be used to produce this transfer pulse.

Depending upon the state assumed by the stage 21, the stage 22 will change its stable state upon the receipt of a transfer pulse. The output signals produced by the stage 22 are derived at the output pins 2 and 3, respectively, and are supplied to the NAND gates **18*b* and 18*a*, respectively, as indications of the actuation of the switch 19. Of course, if desired, an alternative switching circuit can be used to achieve the same effect of conditioning the NAND gates 18*a* and 18*b* depending upon the selective actuation of the switch 19**.

As one example thereof, if the switch 19 is opened, it may be assumed that the state of the stage 22 is such that the NAND gate **18*b* is conditioned to transmit a relatively low-level pulse to the NAND gate 18*c* during the first timing pulse $\Delta T$ supplied to the NAND gate 17 by the NOR gate 16. Consequently, during this first timing pulse $\Delta T$, the NAND gate 18*c* conditions the NAND gate 17 to transmit the pulse of frequency $f_x$. However, during the next timing pulse $\Delta T$, the signal supplied to the NAND gate 18*b* by the stage 23*a* disables this NAND gate which, in turn, conditions the NAND gate 18*c* to disable the NAND gate 17**. Consequently, further pulses of the frequency $f_x$ are not transmitted. Accordingly, such pulses are transmitted only during the first timing pulse in a group of four such timing pulses.

Now, if it is assumed that the switch 19 is closed, the pulse shaping circuit 20 is actuated to supply a pulse to the clock input pin 9 of the stage 21. This, in turn, causes the stage 21 to change its state and, upon the receipt of the next transfer pulse $T_r$, the stage 22 likewise will change its state. With this change in state, the NAND gate **18*a* now is conditioned by the signal supplied thereto from the output pin 3 of the stage 22, while the NAND gate 18*b* is disabled. As thus conditioned, the NAND gate 18*a* supplies the pulse derived at the output pin 5 of the stage 23*a* to the NAND gate 18*c*. This causes the NAND gate 18*c* to be disabled only during the second timing pulse in a group of four such timing pulses. Hence, the pulses of frequency $f_x$ are transmitted by the NAND gate 17 only during the second timing pulse when the switch 19** is closed.

Of course, the foregoing description of the operation of the gating circuit 18 to control the operation of the NAND gate 17 is overridden when the switch 13 is closed. When this condition obtains, the NAND gate 17 transmits the pulses of frequency $f_x$ during the first two timing pulse in a group of four such timing pulses, regardless of the condition of the switch 19.

Turning now to FIG. **2*c*, it is seen that the pulses transmitted by the NAND gate 17 are supplied by the conductor g to the first stage of the counter 10. This counter is comprised of three stages, each constituted by an SN 7490N. Consequently, depending upon the number of pulses which are transmitted, these pulses are counted by the counter circuit 10**.

The pulses of frequency $f_y$ are transmitted by the NAND gate 15'' over the conductor e to the first stage of the counter circuit 11. The counter circuit 11 is formed of three stages, each constituted by an SN 74192N. It is seen that the counter stage 11 is similar to the aforedescribed variable divider 7 shown in FIG. **2*a***.

The output pins of each stage of the counter circuit 10 are connected to corresponding input pins of associated stages in the counter circuit 11. Thus, the count attained by the counter circuit 10 is seen to preset the dividing ratio of the counter circuit 11. In this manner, the number of pulses which are supplied to the counter circuit 11 by the conductor 8 is divided in accordance with the preset count established by the counter circuit 10. In addition, a conductor 12 is connected to a reset terminal included in each of the stages of the counter circuits 10 and 11, and is further connected to a conductor b. The reset conductor 12 is adapted to receive a reset pulse at the conclusion of each measuring interval. As one example, if a measuring interval is assumed to be comprised of four successive alternation intervals, the reset pulse applied to the conductor 12 may be equal to or synchronized with the transfer pulse $T_r$. As is appreciated, the purpose of the reset pulse is to reset each stage in the respective counter circuits to an initial, or zero, count. In addition, this reset pulse, applied via the conductor b, serves to reset the counter circuit 7 to its initial preset count.

It may be appreciated that, as the NAND gate 17 transmits pulses to the counter circuit 10, the respective stages in that counter circuit are incremented until all of such pulses are counted. Let it be assumed that the count reached by the counter circuit 10 is equal $N_x$.

It is recalled that the NAND gate 15'' is synchronized by the frequency-divided timing pulses applied to the output pin 2 of the stage **23*b*. Thus, this NAND gate 15'' is conditioned to transmit the pulses of frequency $f_y$ during the oscillation period immediately following the period during which the pulses of frequency $f_x$ were transmitted. Therefore, when the pulses of frequency $f_y$ first are transmitted, the count attained by the counter circuit 10 is stable. This causes the divider ratio of the counter circuit 11 to be preset such that the number of pulses of frequency $f_y$ transmitted by the NAND gate 15'' is divided in accordance with this preset ratio. Effectively, this results in a number of output pulses applied to the output terminal 2 which is equal to the quotient $N_y/N_x$, wherein $N_y$ is the number of pulses which are transmitted by the NAND gate 15''**. Hence, this quotient is equal to A, the amplitude of oscillation of the balance.

The manner in which the selector switches 13 and 19 control the operation of the illustrated apparatus now should be understood. When the switch 13 is closed, the NAND gate 17 transmits the pulses of frequency $f_x$ during two successive timing pulses $\Delta T$. At the same time, the pulses transmitted by the NAND gate 15'' during an oscillation period exhibit a higher frequency, $f_o/22$. Thus, by closing the switch 13, the factor $m$ is set equal to unity and the factor $n$ is set equal to 2, in accordance with the following equation:

$$A = \frac{\dfrac{f_o}{22m}}{\dfrac{f_o}{7r}} \cdot \frac{m \cdot n \cdot T_o}{\sum_{i=1}^{n} \Delta T_i} \qquad (3)$$

Conversely, when the switch 13 is opened, the gating circuit 18 controls the NAND gate 17 to transmit the pulses of frequency $f_x$ during only one or the other of the first two timing pulses $\Delta T$ in a group of four such timing pulses. At the same time, the gating circuit 14 is conditioned to supply the pulses of lower frequency $f_o/4$ to the divide-by-eleven circuit; and the pulses transmitted by the NAND gate 15'' have the frequency $f_o/2.22$. Accordingly, by opening the switch 13, the factor m in the foregoing equation is set equal to 2 and the factor n is set equal to unity. Thus, it is appreciated that, in the general equation for the amplitude A of oscillation, m.n equals 2.

Also, when the switch 13 is opened, the switch 19 is adapted to determine whether the pulses of frequency $f_x$ which are transmitted by the NAND gate 17 are transmitted in the first or second timing pulses ΔT included in each group of four such timing pulses. Therefore, when the switch 13 is opened, an operator can measure the amplitude of oscillation A during, for example, the forward swing of the balance, by opening the switch 19. Alternatively, the amplitude of oscillation A can be measured during the return swing of the balance by closing the switch 19. Now, when the switch 13 is closed, the amplitude of oscillation A can be measured for an average over the forward and return swings of the balance.

It is appreciated that the NAND gate 17 serves to transmit a number of pulses of frequency $f_x$ during one or two timing pulses ΔT, depending upon the operation of the switches 13 and 19. The number of pulses so transmitted, which are counted by the counter circuit 10, represent the duration of the timing pulse ΔT. Similarly, the number of pulses which are transmitted by the NAND 15'' represent the duration of an oscillation. Of course, if the switch 13 is closed, the effective number of pulses which are transmitted by the NAND gate 15'' is equal to the number of such pulses which would have been transmitted during an entire oscillation period. It is appreciated that, by varying the frequency of the pulses transmitted by the NAND gate 15'', the accurate measurement of the oscillation period can be determined in half the time otherwise required. By dividing the representation of the vibration duration, i.e., the number of pulses $N_y$ transmitted by the NAND gate 15'', by the representation of the timing pulse, i.e., the number of pulses $N_x$ transmitted by the NAND gate 17, the quotient is equal to A in accordance with equation (2) above.

While the present invention has been particularly shown and described with reference to one preferred embodiment thereto, it will be apparent to one of ordinary skill in the art that various changes and modifications can be made in form and details without departing from the spirit and scope of the invention. For example, the frequency divider circuits 5, 6 and 7 can be replaced by frequency multiplying circuits. Of course, in this alternative arrangement, the frequencies $f_x$ and $f_y$, preferably, should maintain the aforedescribed relationship of $\pi/\tau$. Of course, if a "divide-by-$\pi$" circuit is used, the frequency changing circuits 5 and 6 can be omitted. Similarly, the particular construction of the selection and gating circuit 9 which is shown in FIG. 2*b* can be replaced by equivalent circuits. The various clock pulses, synchronizing pulses, and the like, produced by the selection and gating circuit, can be similarly produced by other equivalent circuits. Furthermore, and as was explained above, the specific circuits identified by the illustrated manufacturers' model numbers can be replaced by other, equivalent circuits capable of performing a similar function.

The pulse representing the amplitude of oscillation A provided at the output terminal 2 can be suppled to further apparatus for indicating this amplitude. For example, a visual display indicator, a graphical display device, or other device used in indicating or processing this amplitude of oscillation can be used, if desired.

Therefore, it is intended that the appended claims be interpreted as including the foregoing as well as various other obvious changes and modifications.

What is claimed is:

1. A method of measuring the amplitude of oscillation of the balance of a timepiece movement having an escapement adapted for disengagement and engagement, successively, the balance having a predetermined angle of lift, comprising the steps of measuring the time intervals between successive disengagement and engagement, measuring the duration of vibration of said balance; counting the number of pulses of a first frequency produced during at least one of said measured time intervals; counting the number of pulses of a second frequency produced during at least one of said vibration durations, said first and second frequencies exhibiting a predetermined relationship relative to each other; and dividing the number of said pulses of said second frequency by the number of pulses of said first frequency, whereby the quotient is equal to said amplitude.

2. The method of claim 1 wherein said step of counting the number of pulses of a first frequency comprises generating a train of pulses of a reference frequency; dividing the frequency of said reference frequency pulses by a factor proportional to said predetermined angle of lift; and counting said divided reference frequency pulses during n time intervals, where *n* is an integer.

3. The method of claim 2 wherein said step of counting the number of pulses of a second frequency comprises dividing the frequency of said reference pulses by a predetermined constant factor; and effectively counting said pulses divided by said predetermined constant factor during m.n vibration durations, where *m* is an integer.

4. The method of claim 3 wherein said step of measuring the time intervals between successive disengagements and engagements comprises detecting the sound produced by said timepiece movement, commencing a time interval when the sound indicative of a disengagement is detected; and ending said time interval when the sound indicative of an engagement is detected.

5. The method of claim 3 wherein said step of measuring the duration of vibration of said balance comprises producing a periodic pulse signal whose pulse duration is equal to the time interval between a disengagement and an engagement; and dividing the frequency of said periodic pulse signal to produce further pulses, each having a duration equal to twice the period of said periodic pulse signal.

6. The method of claim 5 wherein said step of effectively counting said pulses divided by said predetermined constant factor during m.n vibration durations comprises selectively counting during each duration of said further pulses, *m* times the number of pulses divided by said predetermined constant factor.

7. A method of measuring the amplitude of oscillation of the balance of a timepiece movement having an escapement adapted for disengagement and engagement, successively, the balance having a predetermined angle of lift $\tau$, comprising the steps of detecting the sounds produced by said timepiece movement for each disengagement and each engagement; producing a periodic pulse signal corresponding to said detected sounds, said pulse signal having duration $\Delta T$ equal to the interval between a disengagement and an engagement; producing a further periodic pulse signal synchronized with said periodic pulse signal and having a duration proportional to the duration of vibration $T_o$ of said balance; generating a train of reference pulses of constant frequency $f_o$; dividing the frequency of said reference pulses by a factor proportional to said angle of lift $\tau$ to thereby produce first divided pulses; dividing the frequency of said reference pulses by a constant factor to thereby produce second divided pulses, the ratio of the frequency of said first divided pulses to the frequency of said second divided pulses being proportional to $\pi/\tau$; counting the number of said first divided pulses produced during $n$ successive pulse durations $\Delta T$, $n$ being an integar; counting the equivalent number of said second divided pulses produced during $m$ successive vibration durations $T_o$, $m$ being an integer not equal to $n$; and dividing the number of counted second divided pulses by the number of counted first divided pulses, thereby obtaining as a quotient a count representing said amplitude of oscillation $$A = \frac{f_o/\pi}{m \cdot f_o/\tau} \cdot \frac{m \cdot n \cdot T_o}{\sum_{i=1}^{n} \Delta T_i}$$

8. The method of claim 7 wherein said step of producing first divided pulses comprises dividing the frequency $f_o$ of said reference pulses by the factor $7\tau$ to produce first pulses of frequency $f_x = f_o/7\tau$; and said step of producing second divided pulses comprises dividing the frequency $f_o$ of said reference pulses by the factor 22m to produce second pulses of frequency $f_y = f_o/22m$.

9. The method of claim 8 wherein said step of counting the first pulses of frequency $f_x$ comprises selecting the integer n as equal to 1 or 2; and selectively counting said first pulses of frequency $f_x$ during successive durations $\Delta T$ within an oscillation cycle of said balance if $n$ is selected as 2, or during a first duration $\Delta T$ or a second duration $\Delta T$ of said oscillation cycle if $n$ is selected as 1; whereby said amplitude of oscillation is averaged over two vibrations, or is measured during a first or second vibration of said balance movement, respectively.

10. The method of claim 9 wherein said step of counting the second pulses of frequency $f_y$ comprises selecting the integer m as equal to 2 when n is equal to 1, and as equal to 1 when n is equal to 2, respectively; and counting said second pulses of frequency $f_y$ during a single oscillation period.

11. Apparatus for measuring the amplitude of oscillation of the balance of a timepiece movement having an escapement adapted for disengagement and engagement, successively, the balance having a predetermined angle of lift, comprising:

timing pulse producing means for producing first timing pulses having a duration equal to the interval between a disengagement and an engagement;

means responsive to said first timing pulses for producing second timing pulses synchronized with said first timing pulses and having a duration substantially equal to the duration of vibration of said balance;

first pulse generating means for generating first pulses having a frequency proportional to said predetermined angle of lift;

second pulse generating means for generating second pulses having a constant frequency related to said first pulse frequency by the factor $\tau/\pi$;

first counting means for counting the number of said first pulses generated during at least one first timing pulse duration;

second counting means for counting the effective number of said second pulses generated during at least one second timing pulse duration; and dividing means for dividing the counted number of second pulses by the counted number of first pulses, thereby to obtain a resultant count equal to said amplitude of oscillation.

12. Apparatus in accordance with claim 11 wherein said first and second pulse generating means comprise a source of reference pulses; first frequency changing means coupled to said source for changing the frequency of said reference pulses to thereby generate said first pulses; and second frequency changing means coupled to said source for changing the frequency of said reference pulses thereby to generate said second pulses.

13. Apparatus in accordance with claim 12 wherein said first frequency changing means comprises first frequency dividing means for dividing the frequency $f_o$ of said reference pulses by a predetermined factor $7\tau$ to generate said first pulses having a frequency $f_x = f_o/7\tau$; and wherein said second frequency changing means comprises second frequency dividing means for dividing the frequency $f_o$ of said reference pulses by a constant factor 22m to generate said second pulses having a frequency $f_y = f_o/22m$.

14. Apparatus in accordance with claim 11 further comprising selecting means for selecting the number of first timing pulse durations during which said first pulses are counted and the effective number of second timing pulse durations during which said second pulses are counted.

15. Apparatus in accordance with claim 14 wherein said selecting means comprises gate means for receiving said first pulses; means for supplying first timing pulses to said gate means; and control means coupled to said gate means for enabling said gate means to transmit said first pulses during selected first timing pulse durations.

16. Apparatus in accordance with claim 15 wherein said control means comprises manually actuable switch means having first and second states; means responsive to said first state for enabling two first timing pulses to be transmitted by said gate means; means responsive to said second state for enabling one first timing pulse to be transmitted by said gate means; and manually operable means for determining whether the one first timing pulse to be transmitted by said gate corresponds to a first or second interval included in said oscillation period.

17. Apparatus in accordance with claim 16 wherein said selecting means further comprises additional gate means supplied with said second pulses; means for enabling said additional gate means to transmit said second pulses during a second timing pulse duration; and means responsive to the first state of said manually actuable switch means for supplying said second pulses to said additional gate means and responsive to the second state of said manually actuable switch means for supplying second pulses of one-half said constant frequency to said additional gate means; whereby said measured amplitude of oscillation of said balance is averaged over one cycle of oscillation when said manually actuable switch means exhibits said first state and said measured amplitude of oscillation is determined for one interval of said oscillation cycle when said manually actuable switch means exhibits said second state.

18. Apparatus for measuring the amplitude of oscillation of the balance of a timepiece movement having an escapement adapted for disengagement and engagement, successively, the balance having a predetermined angle of lift $\tau$, comprising:

timing pulse producing means for producing first timing pulses having a duration $\Delta T$ equal to the interval between a disengagement and an engagement, and a frequency equal to twice the frequency of vibration;

means responsive to said first timing pulses for producing synchronized second timing pulses having a duration $T_o$ substantially equal to the duration of said vibration;

a source of reference pulses having a constant frequency $f_o$;

first frequency dividing means coupled to said source for dividing the frequency of said reference pulses by a predetermined factor to generate first pulses having a frequency $f_x = f_o/7\tau$;

second frequency dividing means coupled to said source for dividing the frequency of said reference pulses by a constant factor to generate second pulses having a frequency $f_y = f_o/22m$, where $m$ is an integer;

first gate means for receiving said first pulses of frequency $f_x$;

control means coupled to said first gate means for enabling said first gate means to transmit said first pulses during $n$ first timing pulse durations, where n is an integer;

selecting means coupled to said control means and said second frequency dividing means for selecting the value of n and $m$ that n.m is a constant;

first counter means coupled to said first gate means for counting the number of said first pulses transmitted during said n first timing pulse durations so as to attain the count $$N_x = \frac{f_o}{7\tau} \cdot \sum_{i=1}^{n} \Delta T_i;$$

second gate means for receiving said second pulses of frequency $f_y$ for transmitting said second pulses during a second timing pulse duration;

second counter means coupled to said second gate means for counting the number of said second pulses transmitted during second timing pulse durations so as to attain the count $$N_y = \frac{f_o}{22m} \cdot n \cdot m \cdot T_o;$$

and divider means coupled to said first and second counter means for dividing the count attained by said second counter means by the count attained by said first divider means; thereby obtaining the quotient A equal to said amplitude of oscillation, where $$A = \frac{\frac{f_o}{\pi}}{\frac{m \cdot f_o}{\tau}} \cdot \frac{n \cdot m \cdot T_o}{\sum_{i=1}^{n} \Delta T_i}.$$

* * * * *